United States Patent [19]

Berutti

[11] Patent Number: 4,491,438

[45] Date of Patent: Jan. 1, 1985

[54] DELINEATOR POLE, MORE PARTICULARLY FOR SKIING RACE COURSES, HAVING A PIVOTABLE ARRANGEMENT

[75] Inventor: Giampiero Berutti, Germignaga, Italy

[73] Assignee: SPM S.p.A., Brissago Valtravaglia, Italy

[21] Appl. No.: 466,847

[22] Filed: Feb. 16, 1983

[30] Foreign Application Priority Data

Feb. 16, 1982 [IT] Italy ..... 20856/82[U]

[51] Int. Cl.[3] ..... E01F 9/01

[52] U.S. Cl. ..... 404/10; 40/608; 403/229

[58] Field of Search ..... 404/10, 9, 6; 256/1, 256/13.1; 403/2, 229; 40/608, 612; 52/108, 165, 228; 267/150, 171, 169

[56] References Cited

U.S. PATENT DOCUMENTS

| | | | |
|---|---|---|---|
| 1,384,365 | 7/1921 | Walsh | 40/608 |
| 1,435,363 | 11/1922 | Wood | 40/608 |
| 1,679,623 | 8/1928 | Olsen | 40/608 |
| 1,895,229 | 1/1933 | Morton | 403/229 |
| 2,103,410 | 12/1937 | Frei, Jr. | 404/10 X |
| 2,141,067 | 12/1938 | Miller | 404/10 X |
| 3,367,063 | 2/1968 | Bondesen et al. | 52/228 X |
| 4,270,873 | 6/1981 | Laehy et al. | 404/10 |

FOREIGN PATENT DOCUMENTS

| | | | |
|---|---|---|---|
| 42810 | 12/1981 | European Pat. Off. | 404/10 |

*Primary Examiner*—Stephen J. Novosad
*Assistant Examiner*—Beverly E. Hjorth
*Attorney, Agent, or Firm*—Morgan, Finnegan, Pine, Foley & Lee

[57] ABSTRACT

A pivotable delineator pole is disclosed, particularly for skiing range courses, comprising a disc arranged between the tip and the pole, the ends of the tip and the pole being inserted on projections jutting from the opposite faces of said disc, springs acting between said pole and said tip being connected to both the pole and the disc, a clevis being connected at either end to the projections of said disc.

2 Claims, 3 Drawing Figures

DELINEATOR POLE, MORE PARTICULARLY FOR SKIING RACE COURSES, HAVING A PIVOTABLE ARRANGEMENT

In order to provide ski race courses, especially for contests, it is known to use pivotable delineator posts which, as they are tilted down, are capable of returning automatically to their original erected vertical posture.

A post of the kind referred to above is disclosed and shown, for example, in the U.S. Pat. No. 4,270,873. That post comprises a tip intended to be driven in the snow cap, which is connected to the post proper by a resilient connection which enables the post to pivot when a skier bumps into it, to be subsequently restored spontaneously to its vertical posture.

This invention proposes to embody the resilient connection aforementioned by a structure which is very simple to build and cheap while being concurrently extremely reliable in operation.

The resilient connection made according to the invention is characterized in that it comprises a disc arranged between said tip and said pole, the ends of which are inserted on projections jutting from the opposite faces of said disc, said pole and said tip being connected to the disc by respective springs acting between them and either end of clevis the opposite end whereof is linkably connected to the projections of said disc.

The functional and structural features of the invention and its advantages will become fully apparent from the scrutiny of the exemplary description to follow referred to the accompanying drawings, wherein.

Figure 1:
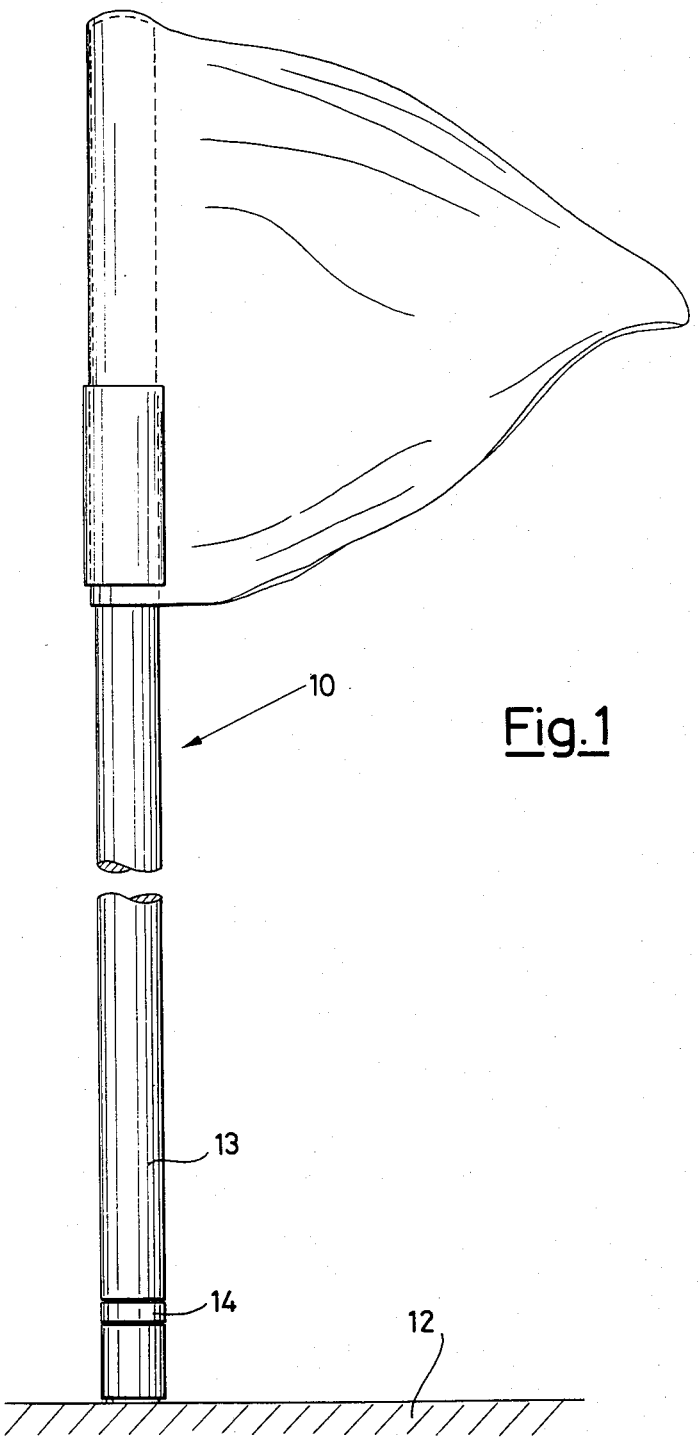
FIG. 1 is a view of a pole made according to the invention.

With reference to the drawings, the pole in question is generally indicated at 10 and comprises a tip 11, adapted to be driven into the snow mass 12, and a section 13 extending therefrom and connected to the tip via a resilient articulated joint.

According to the invention, said resilient joint comprises a central disc 14 from the two opposite surfaces whereof tapered bosses 15, 16 project, to which is linkable connected either end of respective clevises 17, 18. The clevis 17 is inserted in the interior of the tip 11 and at the end away of the disc 14 it carries a header 19 which is freely slidable within the interior of the tip 11.

Likewise, the tip 18 is inserted in the interior of an extension 20 of the section 13 of the pole and carries, on the end away of the disc 14, a head 21 secured thereto, which is freely slidable within said extension 20. As can be seen clearly in the drawings, between said headers 19, 21 and the annular shoulder pieces 22, 23, respectively, of the tip 11 and of the extension 20, respective springs 24, 25 are active which are intended to draw the section 13 of the pole to its vertical position again.

Figure 2:
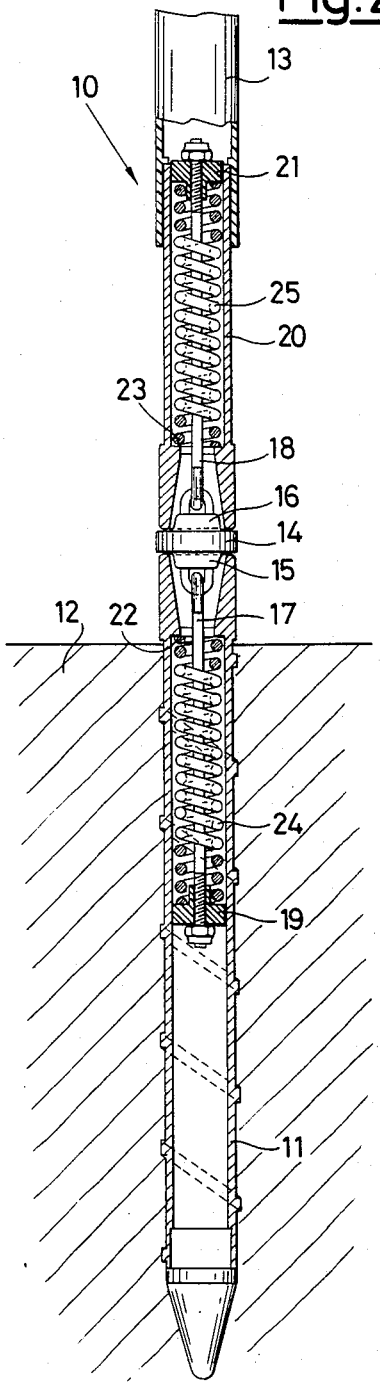
FIGS. 2 and 3 are two detail views in cross section.
Figure 3:
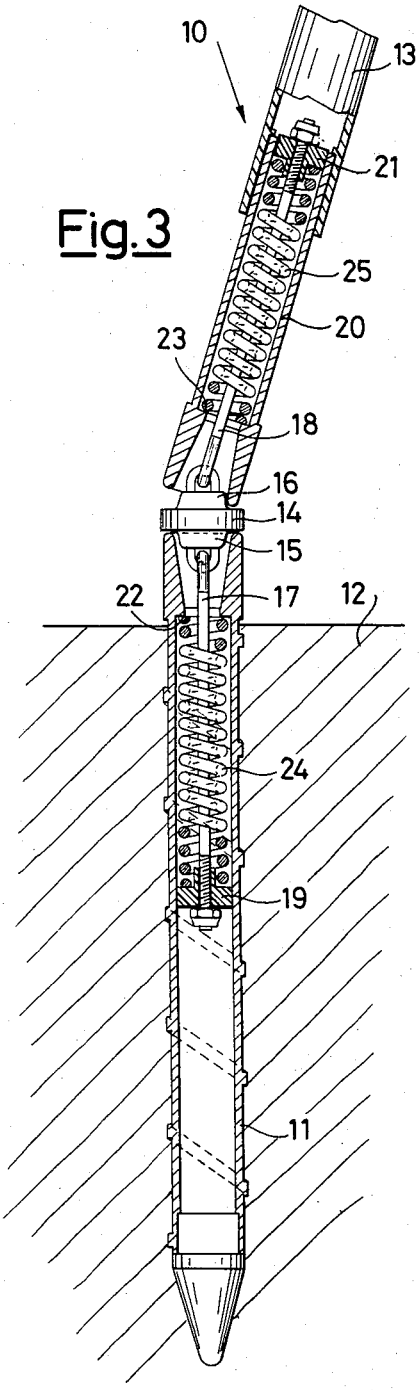

As a matter of fact, as can be easily seen in FIGS. 2 and 3 of the drawings, the bias of the spring 24 acts so as to have the disc 14 brought back to the top portion of the tip 11 dragging with it also the section 13 which, by the bias of the spring 25 is brought back to its vertical situation again against the disc 14 as such.

For a flush coupling, the free ends of the tip 11 and of the section 13 are tapered so as to match the outline of the bosses 15 and 16.

I claim:

1. A delineator pole more particularly for ski races of the kind comprising a pole tip intended to be driven into the snow mass and a pole proper, said pole tip being connected to the pole proper by a resilient joint which enables the pole proper to be tilted when a skier bumps into it and to be then restored to its vertical posture again, characterized in that said joint comprises:

a disc of substantially the same diameter as said pole tip and said pole proper and arranged between said pole tip and said pole proper, one hollow end of said pole tip and one hollow end of said pole proper are inserted on first and second bosses projecting from opposite faces of said disc;

a rigid clevis linkably secured to each of said first and second bosses of said disc; and a spring surrounding each of said rigid clevises, said springs being disposed in the hollow ends of said pole tip and said pole proper respectively and being retained between an annular shoulder in the hollow ends and a slideable header secured to each rigid clevis, whereby said springs cooperate with one another to vertically align said pole tip, said pole proper and said disc.

2. A pole according to claim 1, characterized in that said bosses are tapered, and the corresponding hollow ends of said pole tip and said pole proper are also tapered.

* * * * *